US005284284A

United States Patent [19]

Narishima et al.

[11] Patent Number: 5,284,284

[45] Date of Patent: Feb. 8, 1994

[54] METHOD FOR CONTROLLING SIDE GUIDE MEANS

[75] Inventors: Shigeki Narishima, Yokosuka; Yoshinori Katayama; Koji Minoura, both of Yokohama; Mikio Soya; Hisao Takenaka, both of Chiba, all of Japan

[73] Assignees: Ishikawajima-Harima Jukogyo Kabushiki Kaisha, Tokyo; Kawasaki Steel Corporation, Kobe, both of Japan

[21] Appl. No.: 751,959

[22] Filed: Aug. 29, 1991

[30] Foreign Application Priority Data

Oct. 23, 1990 [JP] Japan ..... 2-285124

[51] Int. Cl.[5] ..... B65H 23/02

[52] U.S. Cl. ..... 226/3; 242/57.1; 226/15

[58] Field of Search ..... 242/57.1; 226/3, 15-23

[56] References Cited

U.S. PATENT DOCUMENTS 2,737,386 3/1956 Reher ..... 226/17
3,114,489 12/1963 Legler ..... 226/15 X
4,407,438 10/1983 Wiechmann .
4,590,778 5/1986 Klockner et al. .
4,643,013 2/1987 Blazevic .

FOREIGN PATENT DOCUMENTS 63-148593 6/1988 Japan .
978773 12/1964 United Kingdom .
1033972 6/1966 United Kingdom .
1093921 12/1967 United Kingdom .
1335584 10/1973 United Kingdom .
2100475 12/1982 United Kingdom .

*Primary Examiner*—John M. Jillions
*Attorney, Agent, or Firm*—Oblon, Spivak, McClelland, Maier & Neustadt

[57] ABSTRACT

A method of guiding a strip (S) of material, e.g. steel, comprises feeding the strip between a pair of spaced guide members (15), through pinch rolls (13) and optionally on to a winder (12) to be coiled. When the strip passes the upstream end of the guide members (15), in a first stage of the method, the members are moved inwardly to narrow the gap between them to a predetermined size greater than the width of the strip. When the leading end of the strip enters the pinch rolls (13), in a second stage of the method, the members move together to further narrow the gap between them. The second stage may, be governed in response to the output from sensors (17, 18) which detect the width of the strip and the position of its centre. The positions of the guide members (15) may be continuously varied to accommodate the varying width of the strip. By varying the position of the centre line of the strip with respect to a mandrel around which the strip is wound, a coil may be produced having a uniformly wound portion affording a flat surface, which portion protrudes on one side of the coil.

6 Claims, 10 Drawing Sheets

METHOD FOR CONTROLLING SIDE GUIDE MEANS

The present invention relates to a method of guiding a strip of material passing through a guide assembly in e.g. a machine for coiling a strip of material, e.g. steel.

Guide assemblies are used in e.g. a hot rolling line, upstream of a down coiler and downstream of a finishing mill.

A strip of material is guided by the guide assembly to a predetermined position and is passed through pinch rolls to the down coiler where the strip is urged by wrapper rolls to a mandrel disposed horizontally and centrally of the wrapper rolls, around which mandrel the strip is wound.

Figure 1:
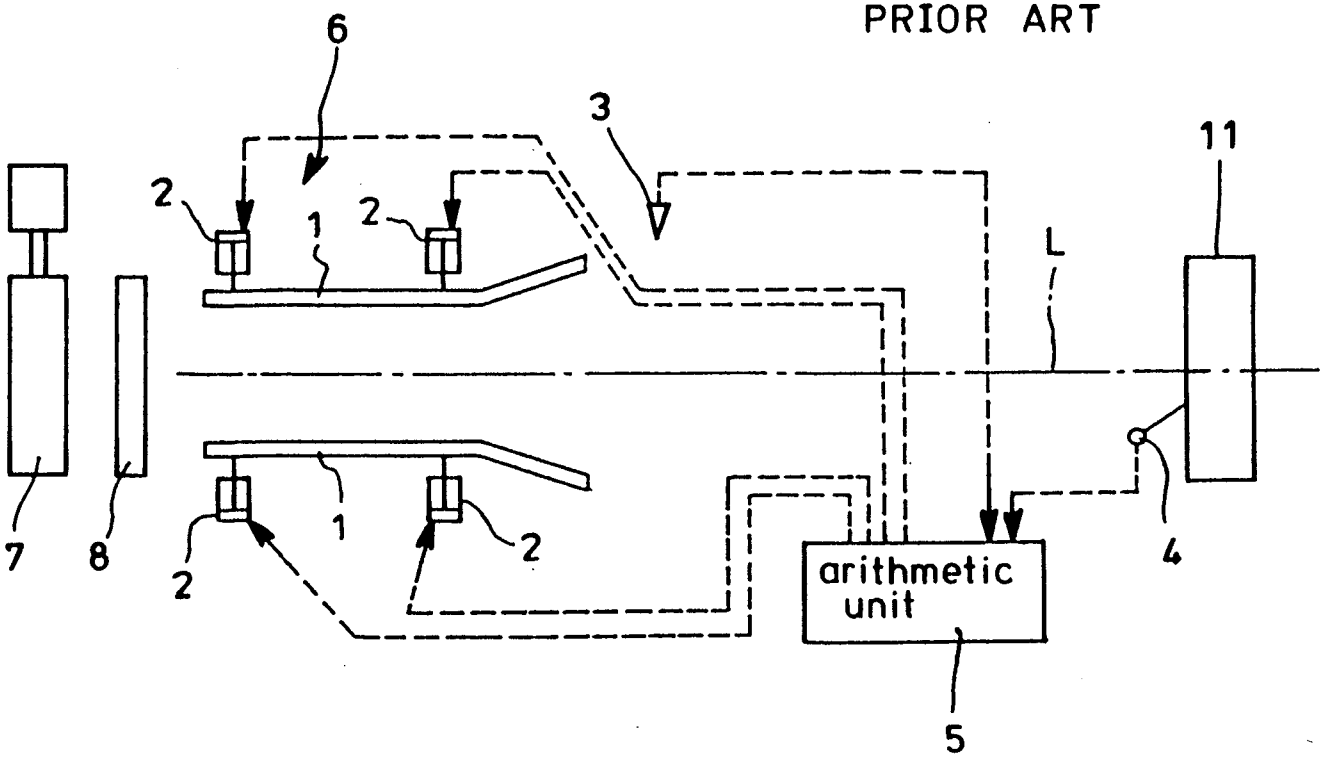
Fig. 1 PRIOR ART
FIG. 1 is a schematic plan view from above of a finishing and winding installation including a known guide assembly.
Figure 2A:
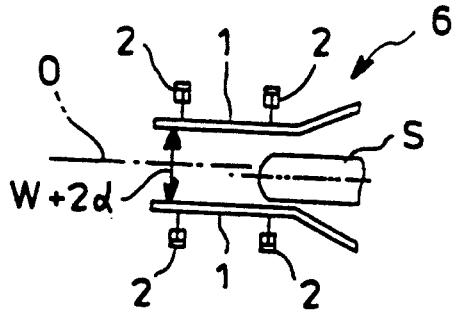
FIG. 2(*e*) shows a coil produced by a known method.
Figure 2B:
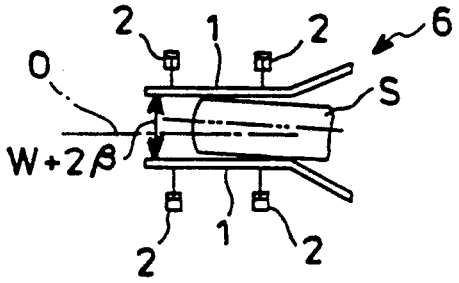
Figure 2C:
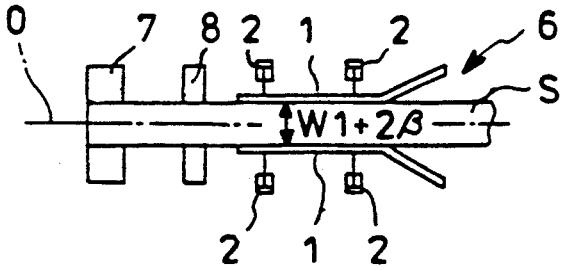
Figure 2D:
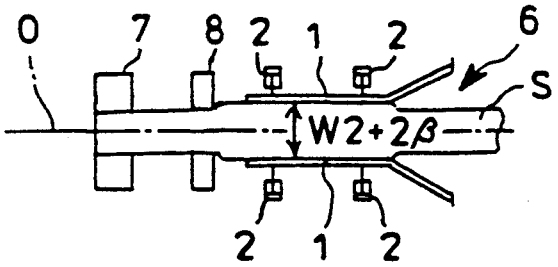
Figure 2E:
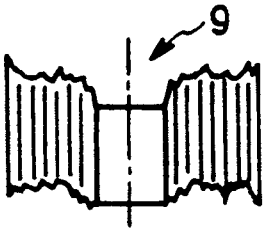

This guide assembly 6 comprises a pair of guide members 1 at opposite sides of a pass line O, that is to say, a notional line along which a strip of material passes through the installation. Each of the guide members 1 has two air cylinders 2 operatively connected thereto to control the degree of opening and spacing of the guide members 1. The guide members are initially spaced well apart from each other. A sensor 3 on the inlet side of the guide assembly detects the passing of the leading end of a strip and a further sensor 4 on the inlet side of the guide assembly detects the velocity of the strip. The signals from the sensors are fed to an arithmetic unit 5 which calculates the time at which the strip enters the guide assembly. On the entry of the strip, the arithmetic unit signals the cylinders 2 to actuate the air cylinders to narrow the gap to a predetermined distance corresponding to the expected width of the strip. Any substantial change to the position of the guide members to accommodate a change in the width of the strip is carried out by means of screws and nuts (not shown). Reference numeral 11 denotes a finishing mill, numeral 7 denotes winding apparatus and numeral 8 denotes pinch rolls.

This method has the disadvantage that the movement of the if guide members 1 into the strip S entering the guide assembly 6, or on engagement of the strip S with the pinch rolls 8, may result in one side edge of the strip S being out of contact with the respective guide member or may cause uneven contact with the guide members 1, due to deviation of the strip 5 from the centre line O. The length of the strokes of the air cylinders also cannot be changed, resulting in poor control.

The final width of the gap between the guide members 1 must be relatively large to accommodate the maximum envisaged width of the strip, which may accordingly cause lateral displacement of the strip, disadvantageously resulting in the development of so-called "telescoping" of the coiled strip which is wound by the machine. "Telescoping" is a phenomenon whereby part of the coil is displaced laterally with respect to the remainder of the coil.

If the strip deviates from the centre line of the installation, the guide members I still guide the strip along the centre line after the strip has engaged with the pinch rolls and the down coiler, so that the strip continues to be gradually deviated. This results in the coil telescoping as well as causing flaws in the strip and wearing of the guide members 1 due to large forces between the guide members and the strip.

If the width of the strip changes after the gap between the guide members has narrowed, further problems arise. If the gap is larger than the width of the strip, the coil may telescope, the degree of telescoping depending upon the size of the gap between the strip and the guide members 1. If the gap is smaller than the width of the strip, the strip may be damaged at its side edges and/or may ride over the guide members 1.

Telescoping may occur on the opposite sides of a coil 9 produced by the known method due to variations in width of the strip from the expected widths. As a result, when the coil 9 is laid on a horizontal surface, with its axis vertical, to be transported, the lower side of the coil 9 may be damaged (see FIG. 2(*e*)).

It is an object of the present invention to provide a method of guiding a strip of material which is accurate and thus avoids wear on the guide assembly and lateral instability of the strip as it passes through the assembly.

Figure 3:
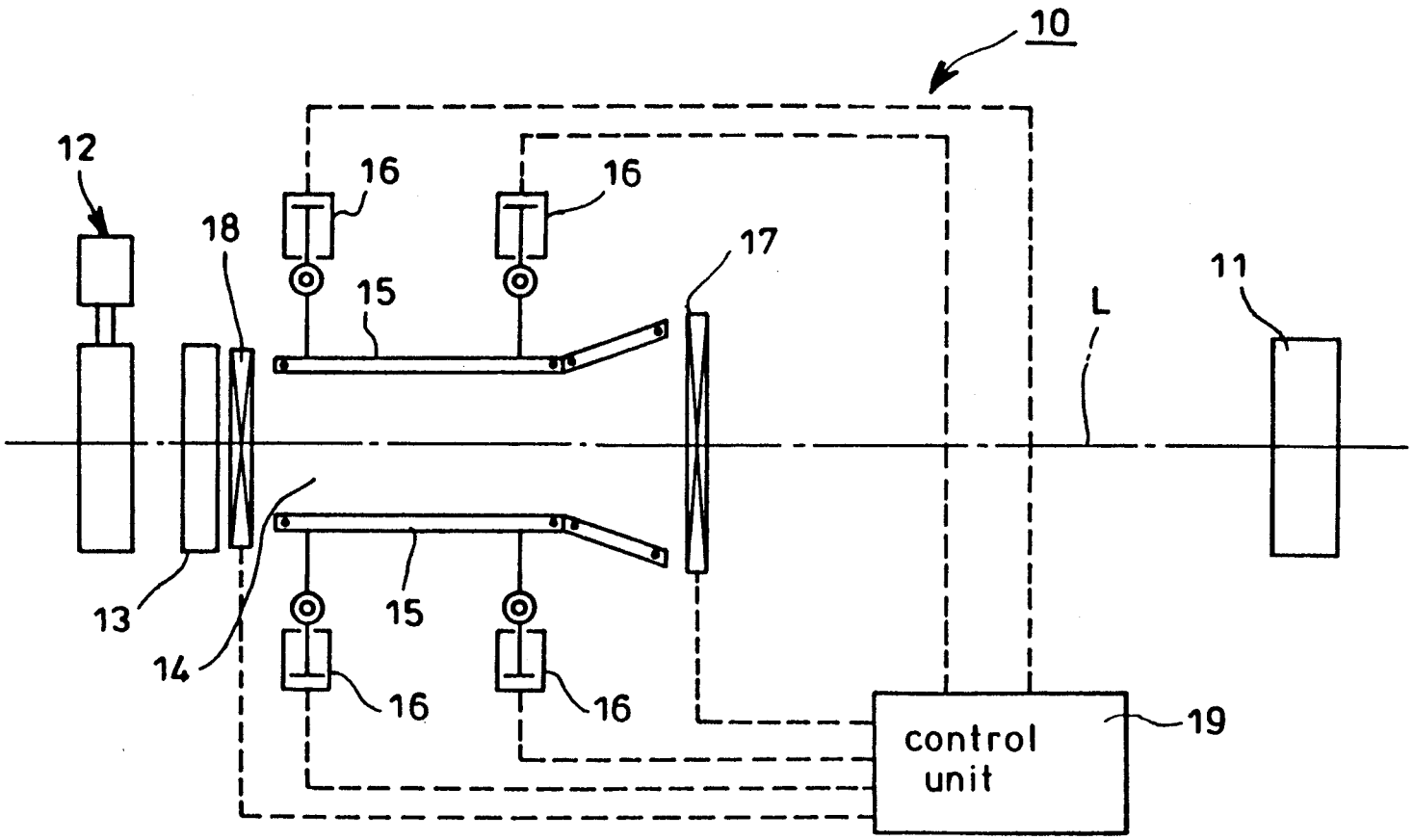
Figure 4A:
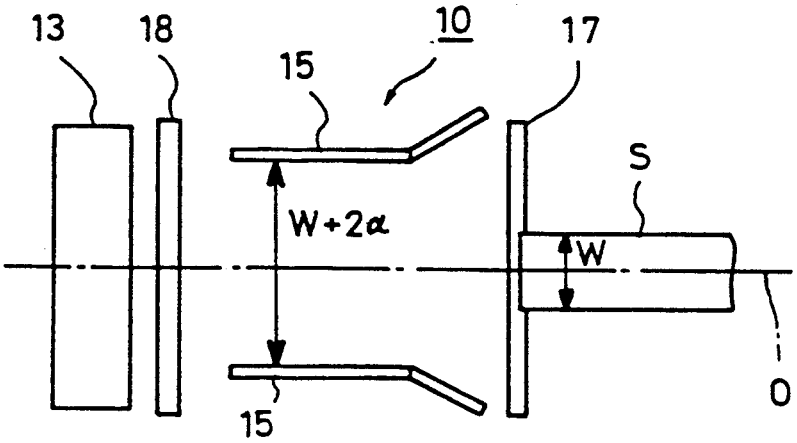
Figure 4B:
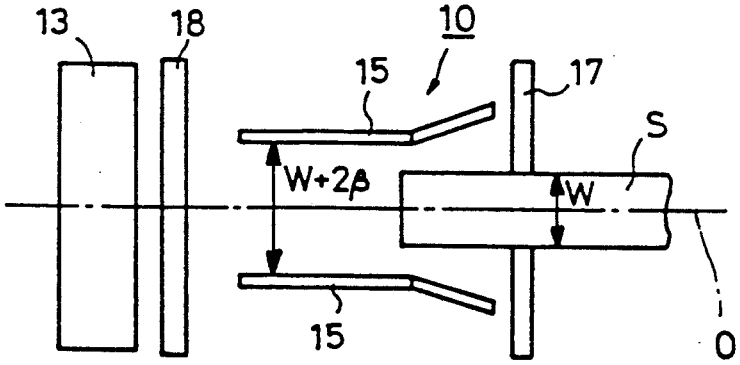
Figure 4C:
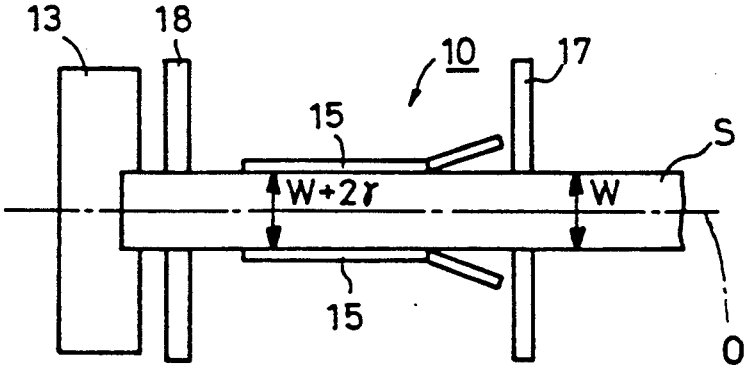
Figure 5A:
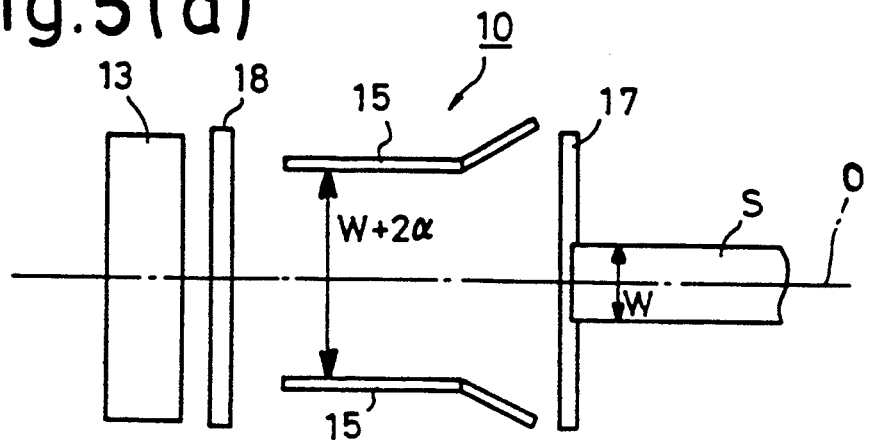
Figure 5B:
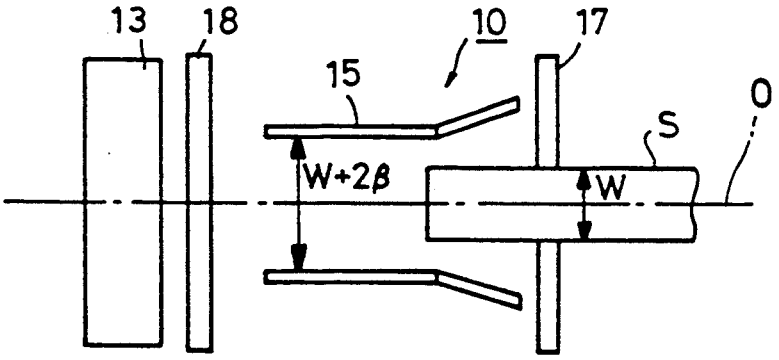
Figure 5C:
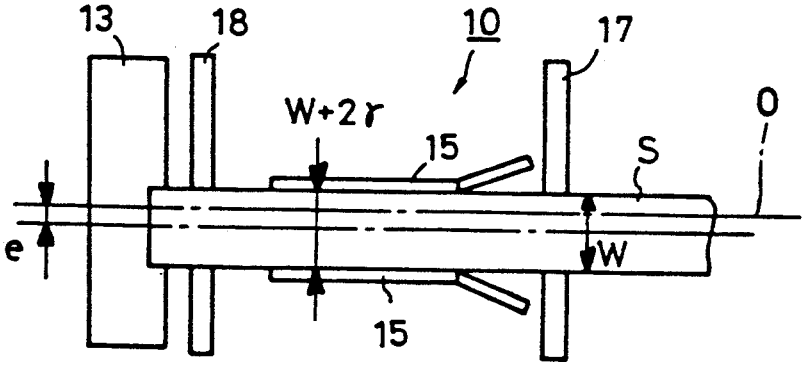
Figure 6A:
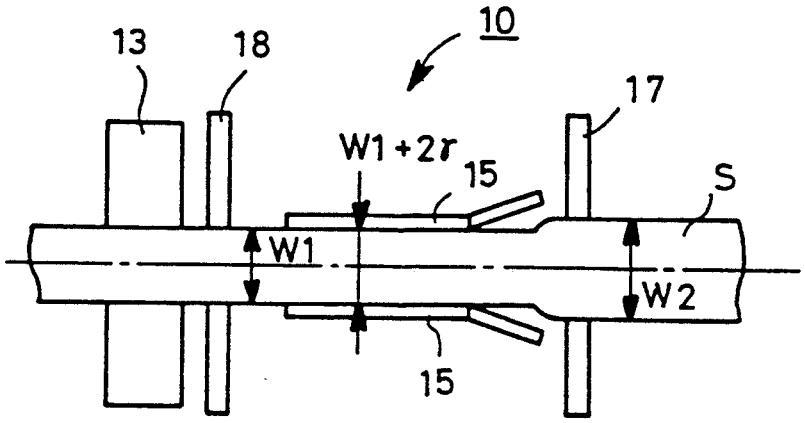
Figure 6B:
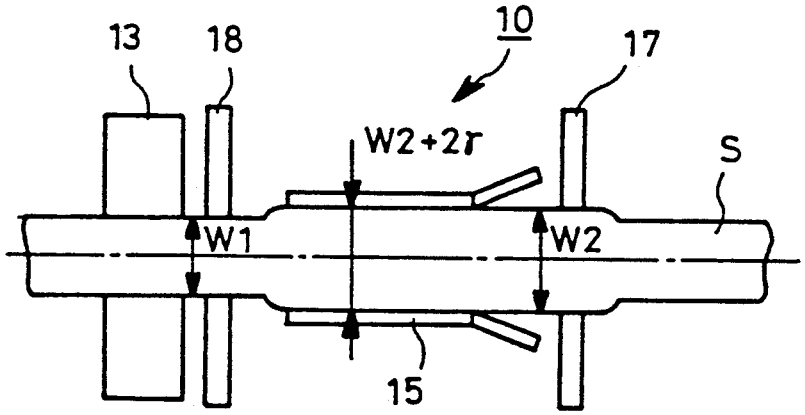
Figure 7A:
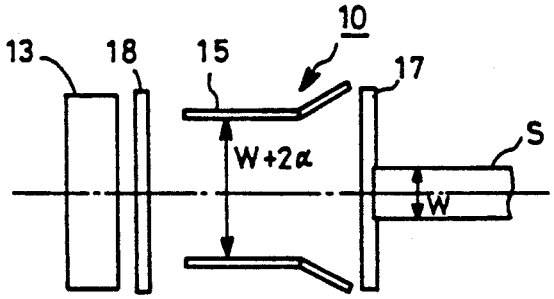
Figure 7B:
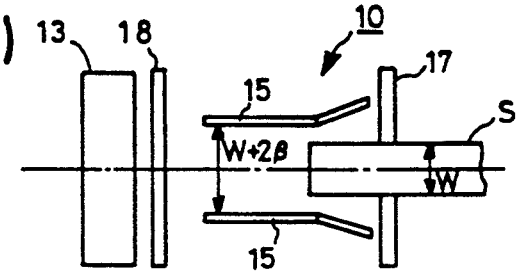
Figure 7C:
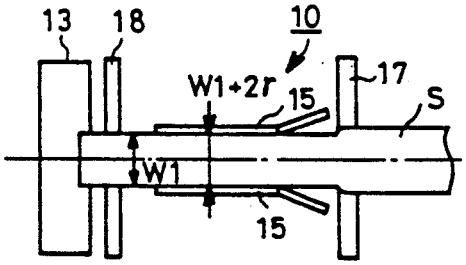
Figure 7E:
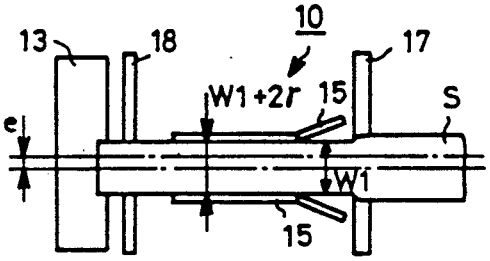
Figure 7D:
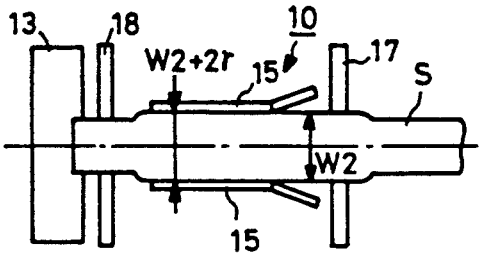
Figure 7F:
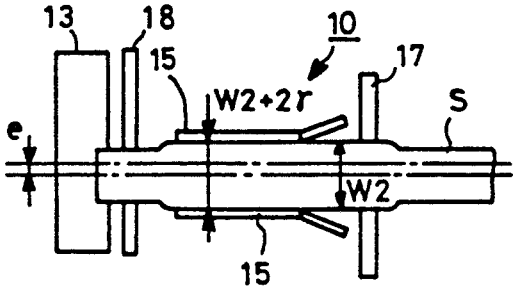
Figure 8:
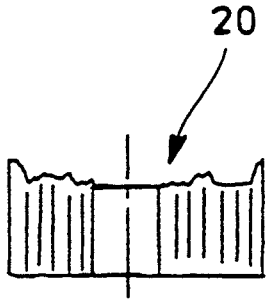
Figure 9:
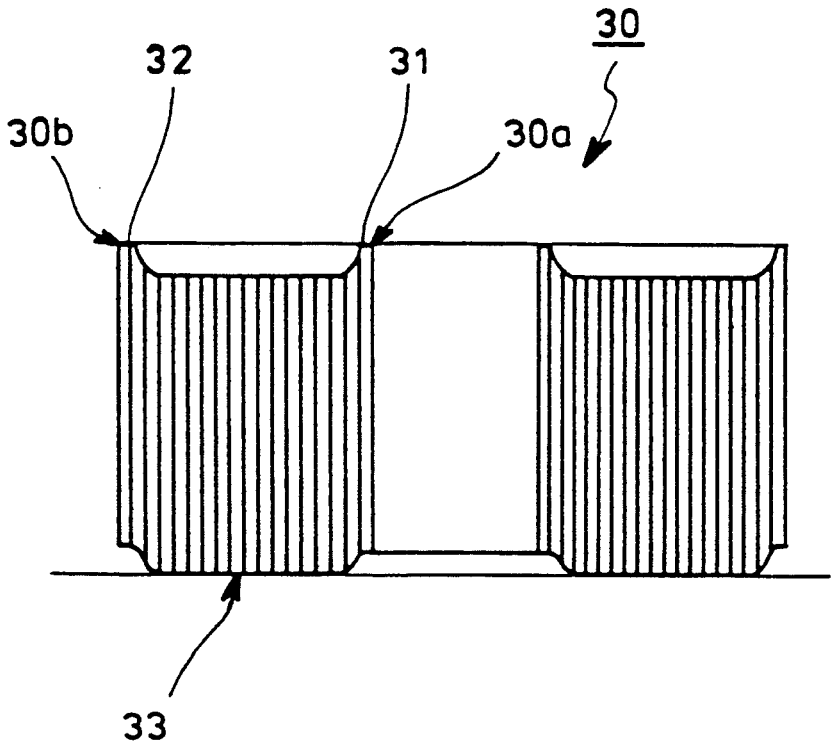
Figure 10:
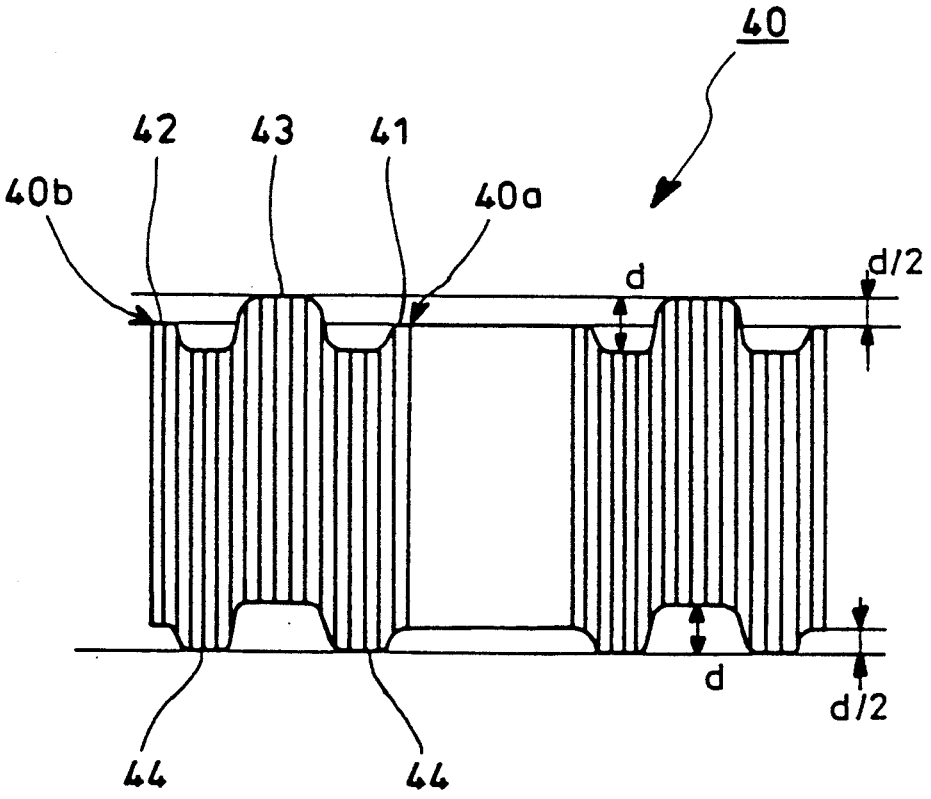

Further objects and advantages of the invention will be apparent from the following description of six specific methods in accordance with the invention, which is given by way of example only, with reference to FIGS. 2(*a*) to 10 of the accompanying drawings in which:

FIG. 1 is a schematic view from above of a finishing and winding installation including a known guide assembly;

FIGS. 2(*a*) and 2(*b*) are schematic plan views from above of a guide assembly, showing one embodiment of the method in accordance with the invention;

FIGS. 2(*c*) and 2(*d*) are schematic plan views from above of the downstream portion of a finishing and winding installation, showing steps of a variation of the method of FIGS. 2(*a*) and 2(*b*);

FIG. 2(*e*) shows a coil produced by a known method;

FIG. 3 is a schematic plan view from above showing a finishing and winding installation for performing a further embodiment of the method according to the invention;

FIGS. 4(*a*) to 4(*c*) are schematic plan views from above of a guide assembly and pinch rolls showing the steps of the embodiment according to FIG. 3;

FIGS. 5(*a*) to 5(*c*) are schematic plan views from above of a guide assembly and pinch rolls, showing yet another embodiment of the invention;

FIGS. 6(*a*) and 6(*b*) are schematic plan views from above of a guide assembly and pinch rolls showing the steps of still another embodiment of the invention;

FIGS. 7(*a*), 7(*b*), 7(*e*) and 7(*f*) are schematic plan views from above of a guide assembly and pinch rolls showing some of the steps of yet further methods in accordance with the invention;

FIGS. 7(*c*) and 7(*d*) are views similar to FIGS. 7(*a*) and 7(*b*) showing additional steps of one of the methods of the invention;

FIG. 8 is a transverse section through a coil manufactured using the methods according to the invention of FIGS. 7(*a*) through 7(*f*); and FIGS. 9 and 10 are transverse sections through coils manufactured using another method in accordance with the invention.

Referring to FIG. 3, a machine for performing a method in accordance with the invention comprises a guide assembly 10, disposed on a hot run or transfer table 14 between the downstream side of a finishing mill 11 and a set of pinch rolls 13 upstream of a down coiler 12.

The guide assembly 10 comprises a pair of guide members 15 on opposite sides of a line L along which a strip of material passes, in use (the pass line). Thus the longitudinal centre line of the strip constitutes the pass line L. The guide members 15 can be moved toward or away from the pass line L substantially parallel with it or obliquely to it. In order to drive the guide members 15, two or four hydraulic cylinders 16, each with a sensor for detecting the position of the associated piston rod, are attached to each of the guide members 15 through universal joints or the like. The piston rod of each cylinder 16 is driven to any desired position by working oil supplied to the cylinder 16 through a servo valve (not shown). Strip edge sensors 17 and 18 are disposed on the upstream and/or downstream sides of the guide assembly 10. In response to output signals from the sensors, a control unit 19 delivers control signals to the servo valves for the hydraulic cylinders 16.

The guide assembly 10 is controlled by the control unit 19 in the following manner.

Referring to FIGS. 4(*a*) to 4(*c*) in a first method according to the invention, the strip S is transferred from the finishing mill 11 across the transfer table 14 to the guide assembly 10. In this embodiment, the pass line L is coincident with the centre line 0 of the installation. The leading end of the strip S is detected by the sensor 17 (see FIG. 4(*a*)) which accordingly delivers an output signal indicating that the leading end has passed the sensor 17 to the control unit 19. The control unit calculates the time when the leading end of the strip S will enter the guide assembly 10 and the time when it will engage with the pinch rolls 13, based on the velocity of the strip S and the distance from the sensor 17 to the upstream end of the guide assembly 10.

When the leading end of the strip S enters the guide assembly 10 (see FIG. 4(*b*)) the control unit 19 delivers to each of the hydraulic cylinders 16 a first stage short stroke signal to move the guide members so that the initial spacing $W+2\alpha$ (where W is the width of the strip S; and $\alpha$is the gap from a guide member 15 to the adjacent edge of the strip S and is set to for example 50 mm when the strip S is in the waiting state before it enters the guide assembly) is narrowed to $W+2\beta$. The gap between each guide member 15 and the corresponding edge of the strip S after the rip S has entered the guide assembly 10 is designated $\beta$ and is, for example, 15 mm.

Thereafter, when or after the strip S is engaged by the pinch roll pair 13, as shown in FIG. 4(*c*), the control unit 19 delivers to each of the hydraulic cylinders 16 a second stage (or final) short stroke signal so that the spacing between the side members is further narrowed to $W+2\gamma$, $\gamma$ being the distance from each guide member 15 to the corresponding edge of the strip S. $\gamma$ is ideally substantially zero but may be, for example, 0–5 mm.

Though the spacing between the guide members may be changed very quickly, preferably the above two-stage adjustment is effected while the strip S is moving. Thus, prior to the strip S engaging with the pinch roll pair 13, it can be guided smoothly through the guide assembly 10, preventing formation of a telescoped coil on winding the strip S.

Referring to FIGS. 5(*a*) to 5(*c*), a second method in accordance with the invention will be described which accommodates the strip being off-centre. Thus, in this method, the longitudinal centre line of the strip S, when the process of winding it around the down coiler 12 has just begun is used as a reference line for the winding process, and it is not necessary for the longitudinal centre line of the strip S to be colinear with the centre line 0 of the installation of which the guide assembly forms part.

Control of the spacing between the guide members 15 when the strip S passes from a waiting state in which the leading end has not entered the guide assembly to the state in which the leading end is within the guide assembler is effected in a manner substantially the same as that described above in relation to the first method (see FIGS. 5(*a*) and 5(*b*)).

Thereafter when the leading end of the strip S engages with the pinch roll pair 13, the side edges of the strip S are detected by the sensor 18 and an output signal representing their position is delivered to the control unit 19 where arithmetic operations are carried out to calculate where the centre line of the strip S is.

When the position of the centre line of the strip S has been obtained in the manner described above, the control unit 19 delivers to each of the hydraulic cylinders 16 a control signal to carry out the second stage (final stage) short stroke with reference to the calculated position of the centre line of the strip S as shown in FIG. 5(*c*). The cylinders 16 thus operate independently to ensure that the gap between the guide members 15 is centred on the centre line of the strip S. The spacing between the members 15 is narrowed to $W+2\gamma$, the spacing for normal operation, as in the first method. The gap $\gamma$ from each side member 15 to the corresponding edge of the strip S is again ideally substantially zero but may be, e.g. 0–5 mm.

As the winding of the strip S by the down coiler 12 continues, the strip continues to be guided along this calculated centre line.

It follows therefore that, as shown in FIG. 5(*c*), an offset e may exist between the centre line 0 and the centre of the strip and coil.

In this method, there is no deviation of the centre of the guide assembly 10 from the actual centre line of the strip S. Thereby, the wound coil is prevented from telescoping.

This method also prevents the creation of flaws in the side edges of the strip S which may otherwise be generated due to deviation of the centre of the guide assembly 10 from the centre line of the strip S causing the edges of the strip to abrade against or snag on the guide members.

A third method according to the invention will now be described with reference to FIGS. 6(*a*) and 6(*b*).

In this method, variation of the width of the strip S may be accommodated. The width of any particular strip S at the leading end may not be precisely known, and the width of the strip may also vary along its length. The third method relates particularly to accommodating variations in width along the length of the strip.

The width of the strip S as it passes through the guide assembly 10 is detected by the sensor 17 on the upstream side or the sensor 18 on the downstream side, or by both of the sensors 17 and 18, and the output signal or signals therefrom are delivered to the control unit 19.

Then the control unit 19 delivers to each of the hydraulic cylinders 16 a control signal to change the spacing between the guide members 15 to a value which is a sum of the instantaneous value of the strip width W and the value $2\gamma(\gamma=0\text{–}5\text{ mm})$, $\gamma$ being the desired value for the size of the gap between each guide member and the respective side edge of the strip S.

If the width is measured at the sensor 17, an appropriate time lag is allowed for the portion of the strip with the sensed width variation to reach the guide assembly before the gap sew is adjusted. If signals from upstream and downstream sensors are used, these signals may be averaged.

Thus, when the width W1 of the strip S is small, the guide assembly 10 defines a narrow gap with width $W1+2\gamma$ (see FIG. 6(*a*)). When the width of the strip S is large, the guide assembly defines a broad gap with width $W2+2\gamma$ (see FIG. 6(*b*)).

When the spacing between the guide members is to be changed, the control of the gap in the guide assembly is carried out with reference to the lateral centre of the coiled strip: both of the guide members are moved to accommodate changes in the width of the strip, thus keeping the centre line of the strip in the same place with respect to the installation as a whole.

The above described dynamic control of the spacing of the guide assembly 10 prevents swelling and/or flaws being created in the strip S due to the spacing being too small and prevents lateral instability of the strip S due to the spacing being too wide. Telescoping of the coil can be avoided.

A variation on the third method will now be described with reference to FIGS. 2(*a*) to 2(*d*).

When the strip S moves from a waiting position, as shown in FIG. 2(*a*) and enters between the guide members 1 as shown in FIG. 2(*b*), or when the strip S has passed through the guide members 1 and is engaged by pinch rolls 8 (see FIG. 2(*c*)), the guide members 1 close together to guide the strip into line with the centre line 0 of the winding and finishing installation.

The gap between the guide members is initially at a nominal width, $W+2\alpha$, when the strip is at the waiting position. This is changed to $W+2\beta$ thereby guiding the strip to the centre line 0 of the installation. Then, the strip is wound around a down coiler 7. During the winding process predetermined strip widths W1 and W2 (see FIGS. 2(*c*) and 2(*d*)) may be accommodated. In response to the detected widths, the cylinders 2 move guide members 1 relative to the centre line 0 of the installation.

A fourth method according to the invention will now be described with reference to FIGS. 7(*a*) to 7(*f*).

This method is a combination of the first, second and third methods described above.

The fourth method is substantially the same as in the first and second methods up till the completion of the first stage, i.e. after the strip has entered the guide assembly 10 from the waiting state and the spacing of the assembly has narrowed from $W+2\alpha$ to $W+2\beta$.

As the strip S is further advanced to be engaged with the pinch roll pair 13, as shown in FIGS. 7(*c*) and 7(*d*), the sensor 18 on the downstream side of the guide assembly 10 detects the width of the leading end of the strip S and a signal representative thereof is delivered to the control unit 19.

In response to this signal, the control unit 19 delivers a control signal to each of the hydraulic cylinders 16 to change the spacing of the guide assembly to $W+2\gamma$, where W is the width of the leading end of the strip S and $\gamma$ is substantially zero, or may be e.g. 0.5 mm.

Subsequent to the above second stage narrowing based on the width of the leading end, width variations along the length of the strip are detected continuously by sensors upstream and/or downstream of the guide assembly and the spacing between the guide members and the strip maintained as described in relation to the third method.

Information from the sensor 18 is also used to calculate the position of the centre of the strip as in the second method and the narrowing of the guide members in the second stage is centred on this position (FIGS. 7 (*e*) and 7 (*f*)).

During the winding of the strip S, after stage 2, control signals are continuously outputted by the sensors upstream and/or downstream of the guide assembly such that the spacing of the guide assembly 10 is, as in the third method, continuously varied to be the sum of the instantaneous width W of the strip calculated in response to the output signals from the sensors 17 and 18 and $2\gamma$ ($\gamma$=substantially zero or 0–5 mm). The centre of the spacing is kept constant, aligned with the centre of the width of the strip S which was determined in relation to the leading end. Information concerning the centre of the strip and its width at the upstream and downstream sides of the guide assembly may be used to calculate the angle of the strip passing through the guide assembly, and the gap between the guide members may be adjusted accordingly.

Thus, even when the width of the leading end of the strip S is unknown, the spacing between the guide members and the respective edges of the strip can be maintained at a predetermined value, to prevent production of flaws in the strip and lateral instability of the strip. Thereby telescoping is prevented, on winding the strip into a coil.

A fifth method in accordance with the invention will now be described with reference to FIGS. 7(*a*), 7(*b*), 7(*e*), 7(*f*) and 8.

The fifth method may be the same as the fourth method up till completion of the second stage, or either the centering operation or the operation of adjusting the width in accordance with the leading end of the strip may be omitted. Thereafter the guide assembly operates as follows.

One guide member 15 (e.g. the lower one in the figures) is maintained in a stationary state while only the other guide member 15 (the upper one in the figures) is moved.

As a result, the coil 20 (see FIG. 8) into which the strip is wound can telescope only on one side, irrespective of any variation in the width of the strip S. The coil does not telescope on the side of the stationary guide member 15. Subsequent handling of the coil 20, including transportation thereof, is thus facilitated, since the coil 20 may rest stably on its untelescoped side.

As described above, prior to the winding of the strip S by the down coiler 12, the spacing of the guide members is changed in the first stage and then in the second stage. Thereafter the winding is carried out with one guide member maintained stationary, while the other guide member is moved in response to variations in the width of the strip. Therefore, the strip is guided so that telescoping occurs only on one side of the coil 20 (see FIG. 8).

In the description of the first to fifth methods, the guide assembly 10 has been described as being installed upstream of the down coiler, but it is to be understood that the present invention equally applies to a guide assembly installed upstream of a finishing mill.

In the description of the first to fifth methods, it has been stated that narrowing of the spacing of the guide assembly in the first stage is carried out in one step, but it is to be understood that the first stage may alternatively be carried out in a plurality of discrete steps.

A sixth method according to the invention will now be described with reference to FIGS. 9 and 10.

In the sixth method, the position of the centre line of the strip is changed by means of the guide members 15 during winding, to form coils 30, 40 such as those shown in FIGS. 9 and 10, respectively.

The coil 30 (FIG. 9) serves to overcome certain problems encountered with coils intended to be laid on one side. A flat wound portion 33 is deliberately made to protrude on one side beyond the inner and outer regions of the coils 31, 32, composed of the leading and trailing ends of the strip 30*a*, 30*b*, which are telescoped.

In FIG. 9, the flat wound portion 33 protrudes in the opposite direction to the inner and outer regions of the coil. However, it is to be understood that the flat wound portion 33 may be formed to protrude on the same side as the inner and outer regions 31, 32, as long as the flat wound portion 33 extends beyond the inner and outer portions 31 and 32.

The coil 30 can be laid on its flat wound portion, and thus easily transported. Damage to the sides of the coiled strip, particularly at the inner and outer portions which tend to telescope, can be prevented.

The coil 40, shown in FIG. 10, may be laid on either side. A protruding flat wound portion 43 is formed on one side of the coil which protrudes beyond the telescoped regions 41 and 42 at the inner and outer portions of the coil, which protrude in the same direction as the flat wound portion 43. The other side of the coil has two separate flat wound portions 44.

The flat wound portion 43 has a protruding height d, whilst the telescoped portions 41 and 42 have a protruding height d/2. The two flat wound portions 44, which define a groove opposite the flat wound portion 43, have a protruding height of d with respect to the bottom of the groove and a protruding height d/2 with respect to the telescoped portions 41, 42.

The coil 40 thus has one flat wound portion 43 on one side thereof and two spaced flat wound portions 44 on the other side. Alternatively, the single flat wound portion 43 may protrude on one side, together with the telescoped portion 41 comprising the leading end 40*a* of the strip, and a single flat wound portion 44 may protrude on the other side, together with the telescoped portion 42 formed by the trailing end 40*b* of the strip.

Either of the above coils may be laid down stably with either side facing downwards. Damage to the sides of the coiled strip, particularly at the projecting/ recessed telescoped portions 41, 42 may thus be prevented.

When it is desired to wind the strip into a coil of the type shown in FIGS. 9 or 10, the spacing of the guide assembly and position of the centre thereof can be calculated depending upon the desired shape of coil, the width of the strip and length of the strip and the position of the leading edge of the strip to be wound. In response to control signals from the control unit 19, the working oil fed through the servo valves to the hydraulic cylinders 16 is controlled, thereby controlling the centre position of the guide members 15 and the spacing therebetween. In this case, the position of the centre of the strip S is changed by the action of the guide members 15 on the sides of the strip. Displacement of the guide member or members 15 is effected by the two hydraulic cylinders 16 on each member and the servo valves;, in response to the output signals from two position sensors.

In determining the position of the guide members 15, information about the position of the actual centre of the strip and width of the strip may be sensed, using the upstream and downstream sensors 17 and 18, and fed back to the control unit 19.

In the above description, it has been stated that one side of a coil is formed with one or two flat wound portions; but it is to be understood that, depending upon the size of the coil, any number of flat wound portions may be formed on either side of the coil.

In order to wind the strip in the form of a coil as shown in FIG. 9 or 10, the mandrel of the down coiler may be displaced laterally, rather than the centre of the guide assembly being moved.

What is claimed is:

1. A method of guiding a strip of material comprising feeding a leading end of the strip into a guide assembly which defines a gap between parallel guide members through which the strip may pass and narrowing the gap in two stages while maintaining the guide members parallel to each other, the first stage occurring on the introduction of the leading end of the strip into the upstream end of the guide assembly, the second stage occurring on or after engagement of the leading end of the strip with pinch rolls downstream of the guide assembly.

2. A method as claimed in claim 1 comprising the step of establishing the position of the longitudinal centre line of the strip by sensing the position of the centre of the strip at one or both of a point upstream and a point downstream of the guide assembly, after the strip has engaged with the pinch rolls, and then carrying out the second stage, with the centre of the gap being adjusted to be coincident with the established position of the centre line of the strip.

3. A method as claimed in claim 1 or claim 2 including the step of measuring the width of the leading end of the strip after the first stage and then carrying out the second stage which comprises narrowing the gap to a size which is directly dependent on the measured width.

4. A method as claimed in claim 3, wherein after the second stage the size of the gap is varied in dependence on the width of the strip as it passes through the guide assembly, which is sensed on one or both of the upstream and downstream sides of the guide assembly.

5. A method as claimed in claim 1 or 2 wherein after the second stage the size of the gap is varied in dependence on the width of the strip as it passes through the guide assembly, which is sensed on one or both of the upstream and downstream sides o the guide assembly.

6. A method as claimed in claim 1 wherein the guide assembly comprises two spaced guide members and a hydraulic servo system for controlling the guide members between which the gap is defined, one member being located on each side of the strip when it is passing through the assembly, and wherein after the second stage only one of the guide members is moved by said servo system to change the size of the gap.

* * * * *